US006692292B2

(12) United States Patent
Huiskamp et al.

(10) Patent No.: US 6,692,292 B2
(45) Date of Patent: Feb. 17, 2004

(54) TERMINAL BLOCK WITH KNIFE CONTACT AND CONNECTOR MEANS

(75) Inventors: Gerhard Huiskamp, Lage (DE); Joerg Diekmann, Helpup (DE)

(73) Assignee: Weidmueller Interface GmbH & Co., Detmold (DE)

( * ) Notice: Subject to any disclaimer, the term of this patent is extended or adjusted under 35 U.S.C. 154(b) by 0 days.

(21) Appl. No.: 10/231,038

(22) Filed: Aug. 30, 2002

(65) Prior Publication Data

US 2003/0045178 A1 Mar. 6, 2003

(30) Foreign Application Priority Data

Sep. 5, 2001 (DE) ..... 201 14 612 U

(51) Int. Cl.[7] ..... H01R 4/24
(52) U.S. Cl. ..... 439/417; 439/717
(58) Field of Search ..... 439/417, 395, 439/717, 716, 928

(56) References Cited

U.S. PATENT DOCUMENTS 5,615,079 A * 3/1997 Eggert et al. ..... 439/716
5,651,702 A * 7/1997 Hanning et al. ..... 439/715
5,759,071 A * 6/1998 Hanning et al. ..... 439/716
6,120,315 A * 9/2000 Gaertner et al. ..... 439/417
6,135,804 A * 10/2000 Lux ..... 439/397

FOREIGN PATENT DOCUMENTS

| | | |
|---|---|---|
| DE | 37 10 896 | 10/1988 |
| DE | 196 50 989 | 6/1998 |
| DE | 197 32 182 C1 | 3/1999 |
| DE | 299 08 384 U1 | 9/1999 |
| DE | 100 06 885 | 8/2000 |
| DE | 100 45 764 A1 | 4/2001 |
| DE | 199 21 960 C1 | 5/2002 |
| EP | 06 34 813 A2 | 1/1995 |
| GB | 2 287 367 | 9/1995 |
| WO | WO 94 08362 | 4/1994 |
| WO | WO 99 04455 | 1/1999 |

* cited by examiner

*Primary Examiner*—Gary Paumen
(74) *Attorney, Agent, or Firm*—Lawrence E. Laubscher, Sr.

(57) ABSTRACT

A terminal block assembly includes an electrical terminal having a first stationary contact provided with insulation-piercing knife edges, and a second contact arrangement for connecting the terminal to a corresponding terminal on an adjacent terminal block assembly, the second contact arrangement including a male connector and a female jack connector that are arranged in opposite directions transversely of the terminal block body, thereby to afford connection with the corresponding terminal of an adjacent terminal block assembly mounted on a common support rail with the terminal block assembly.

18 Claims, 10 Drawing Sheets

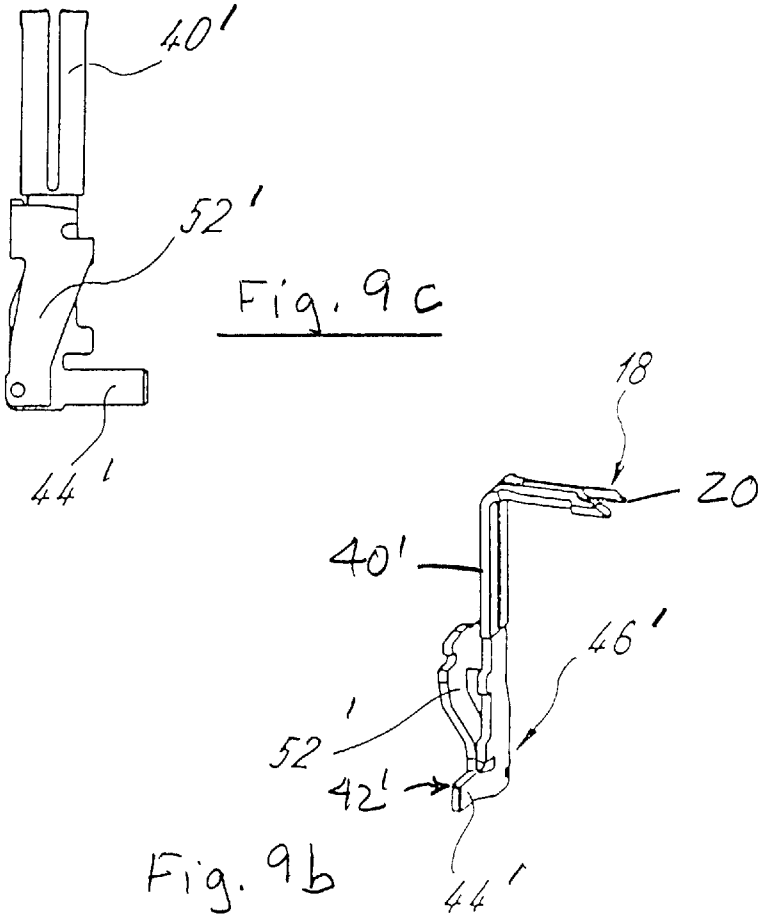
Fig. 9c
Fig. 9b
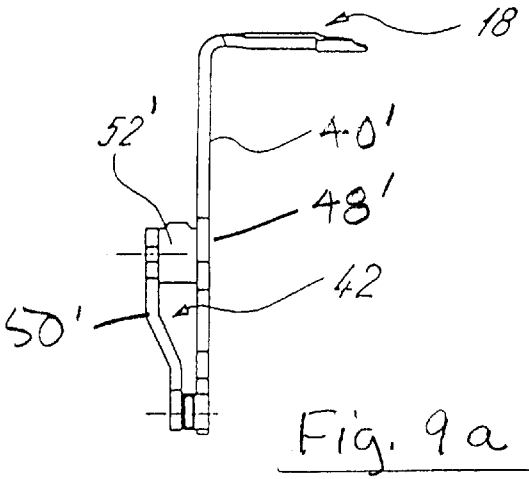
Fig. 9a
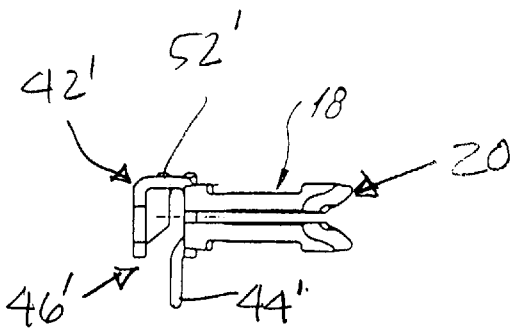
Fig. 9d

TERMINAL BLOCK WITH KNIFE CONTACT AND CONNECTOR MEANS

REFERENCE TO RELATED APPLICATIONS

This application is related to the copending applications of Stuckmann, et al., Ser. No. 09/950,603 filed Sep. 13, 2001, and Wilmes, et al., Ser. No. 09/950,602 filed Sep. 13, 2001.

FIELD OF THE INVENTION

A terminal block assembly is provided that includes at least one terminal having at one end insulation-piercing knife means for connection with the internal conductor of an insulated conductor, and including at its outer end lateral connection means spaced from said knife means, said lateral connection means including a lateral male connector extending laterally from the terminal block body for connection with the corresponding terminal of an adjacent second terminal block assembly, and female connecting jack means arranged for connection with the lateral male connector of a third terminal block assembly arranged on the opposite side of said terminal block from said second terminal block assembly.

BACKGROUND OF THE INVENTION

Brief Description of the Prior Art

Terminal block assemblies including insulation-piercing knife means are well known in the prior art, as shown by the German patent No. DE 19732182 C1, and U.S. patents to Goertner, et al., U.S. Pat. No. 6,120,315, and Lux U.S. Pat. No. 6,135,804, among others. Such terminal blocks and connection devices permit the contacting of the conductors by way of the so-called IDC technique where cutters of the connection device cut through the insulation of the conductor, whereupon the contacting of the line leads takes place in a contacting area. Removing the insulation of the conductor with a special tool is no longer required.

It is also known in the prior art to provide electrical connections between a plurality of terminal blocks mounted in a stacked side-by-side relation on a common support rail, as evidenced by the prior patents to Eggert, et al., U.S. Pat. No. 5,615,079, and Hanning, et al., U.S. Pat. Nos. 5,651,702 and 5,759,071, among others.

There is a need for electrical distribution between several terminals, especially in the area of initiator/actor terminals. The object of the invention therefore is so to develop a terminal block of the typical kind and the connection device of the typical kind that an electrical distribution over several terminal blocks mounted on a common support rail can be accomplished without any problems and in a relatively simple manner.

SUMMARY OF THE INVENTION

Accordingly, it is a primary object of the present invention to provide a first terminal block assembly including at least one electrical terminal having at one end a stationary contact including insulation-piercing knife means, and means spaced from said knife means for electrically connecting said terminal with the corresponding terminal of a second terminal block assembly mounted on the same mounting rail as the first terminal block assembly.

According to a more specific object of the invention, the electrical terminal is provided at one end with first connector means including inwardly directed insulation-piercing knife means, and at the other end with second connection means including a laterally extending male connector, and a female jack connector. This affords the special advantage that by virtue of the design of the terminal at one of whose ends the cutting connection and at whose other end connected therewith in one piece the lateral connecting means is thus designed in a constructively simple manner. Preferably, the lateral connecting means is made at low cost and in a functionally reliable manner according to the kind shown in European Patent No. EP 0 634 813 B1.

Preferably, the male connector and the female jack connector are aligned normal to the main extension plane of the terminal block; i.e., parallel to the direction of the common support rail.

In a particularly preferred manner, the terminal block body is formed from synthetic plastic insulating means and contains recesses that receive the male connector and female jack connector, respectively. A separate housing for the cross-connectors, as proposed in European Patent No. EP 0 634 813 B1 according to which the lateral connecting means in each case have separate housings and initially are stuck together to form strips which are then inserted into the terminal housings as unit, can in this manner be omitted.

According to another particularly preferred modification, a protective ledge for the male connector is formed from the insulation material housing in the direction of the carrying rail or normal to the main extent plane of the terminal block, which ledge protects the male connector against damage by an improperly aligned activation tool (typically a screwdriver).

In a practical manner, the electrical terminal is provided with additional functional areas integrated into it.

According to one particular modification, the male contact, made angled into itself, is molded upon the connecting sheet metal piece; this male contact has a soldering opening for connection with an electrical component. Alternatively, a soldering pin or a jack or plug contact can be molded upon the connecting sheet metal piece. With the help of these functional areas, the connection device, for example, can be connected/combined with electronic components or with printed circuit boards or similar devices.

It is now possible to shape the entire cutting rail at low cost as an integral punch/bending part from a single metal sheet.

BRIEF DESCRIPTION OF THE DRAWINGS

Other objects and advantages of the invention will become apparent from a study of the following specification when viewed in the light of the accompanying drawings, in which:

FIGS. 9*a*–9*d* are side elevation, right side perspective, left hand end, and top views, respectively, of another embodiment of the invention.

DETAILED DESCRIPTION

Figure 1:
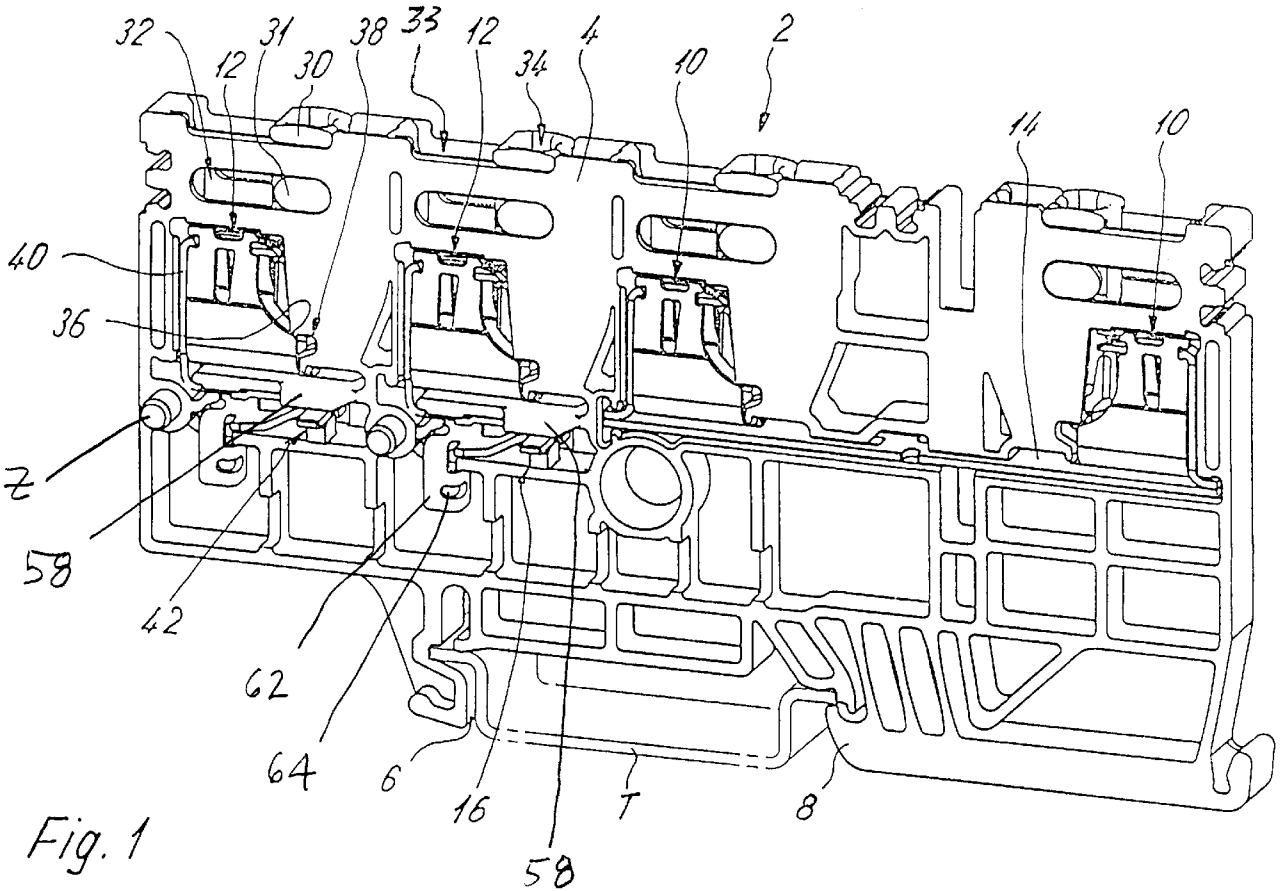
FIGS. 1 and 2 are side perspective and elevation views, respectively, of the terminal block assembly of the present invention.
Figure 2:
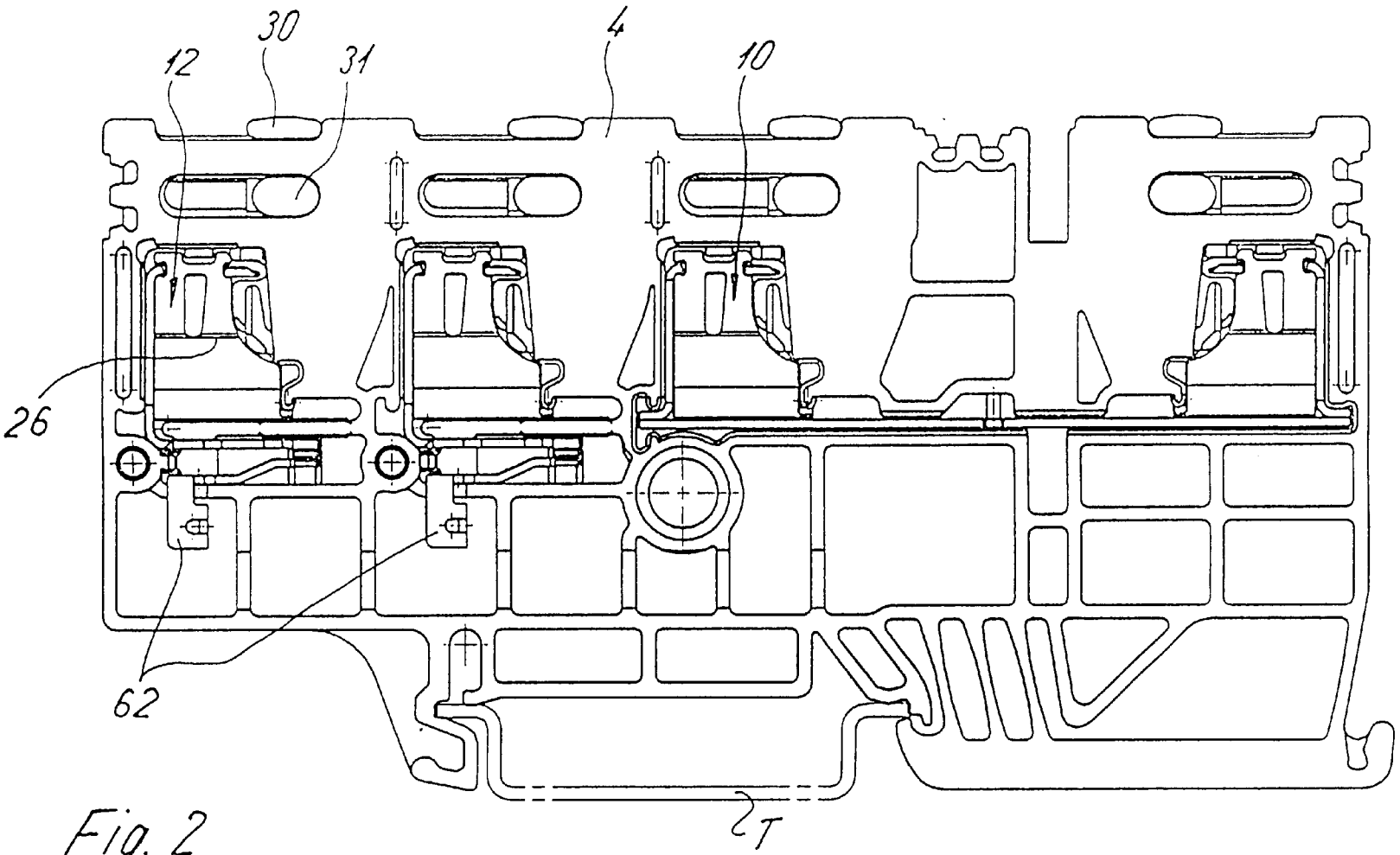
Figure 4B:
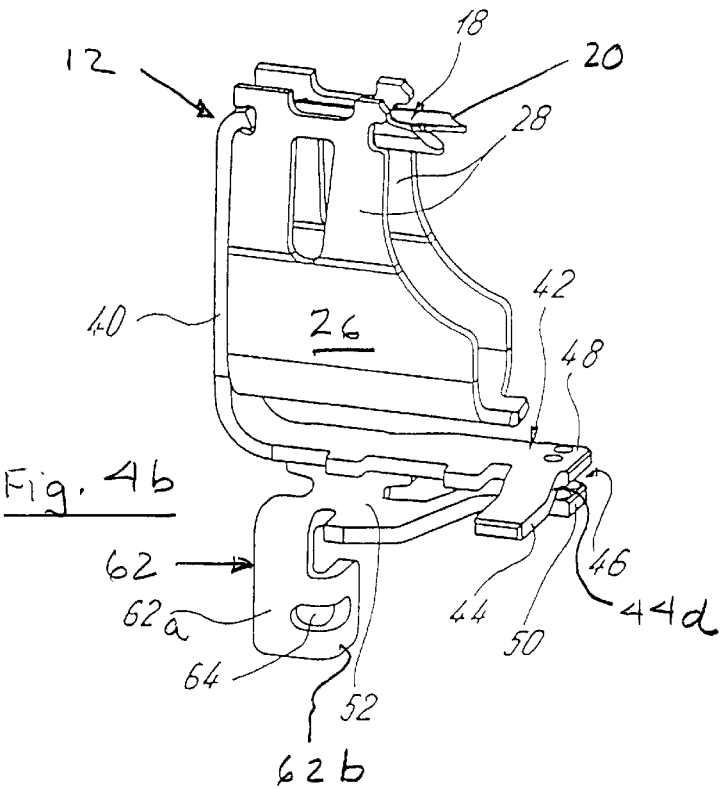
FIGS. 4*a*–4*c* are side elevation, side perspective, and top views, respectively, of the terminal of the present invention, as supported by a contact support spring.

Referring first more particularly to FIGS. 1 and 2, the terminal block assembly 2 of the present invention includes a terminal block body 4 that is formed from a suitable synthetic plastic insulating material, and which includes a pair of mounting feet 6 and 8 for mounting the terminal block assembly on a support rail T, which is normally grounded. The terminal block body contains a plurality of chambers in which are mounted a pair of first electrical terminals 10 that are electrically connected with a bus bar 14, and a pair of second terminals 12 which, in accordance with the present invention, are provided with lateral connection means 16. Each of the terminals includes a bifurcated stationary contact 18 that is provided at its free extremities with knife means 20. The stationary contacts 18 are laterally supported by U-shaped support springs 26 having upwardly extending leg portions 28 that laterally support the stationary contact 18, as best shown in FIG. 4*b*. The contact support spring 26 is provided with a longitudinal projection 36 that extends beneath an abutment 38 on the body 4, thereby to support the support spring and the contact 18 relative to the terminal block body 4.

As is known in the art, movable actuator members 30 are provided having vertical bores 34 for receiving the insulated conductors C that are to be connected with the terminals 10 and 12, respectively. The actuators have guide pins 31 that extend laterally outwardly within guide slots 32 contained in the side walls of the chambers in which the actuators are mounted. Thus, an insulated conductor C is inserted at one end within the vertical bore 34 contained in an actuating member 30, whereupon the actuating member is displaced from a disengaged position toward an engaged position in engagement with the stationary knife portions 20 carried by the resilient stationary contact 18. During the movement of the actuator member between its disengaged and engaged positions, it is guided by the cooperation between guide pins 31 and guide slots 32.

Figure 4A:
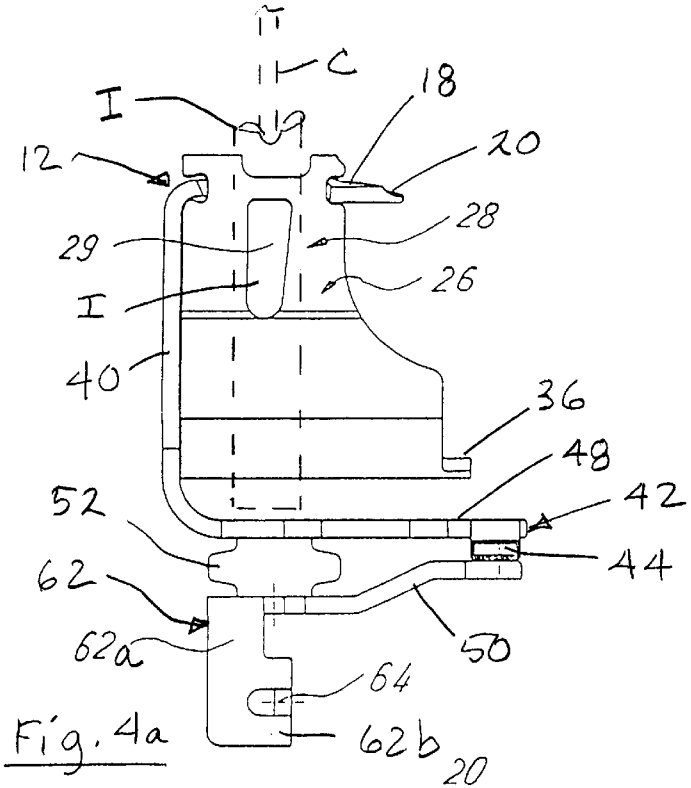

The terminals 12 of FIG. 1 are generally U-shaped and include a vertical body portion 40, as best shown in FIG. 4*a*, the resilient stationary contact 18 being arranged horizontally and normal to the upper end of the vertical terminal portion 40. At its lower end, the terminal portion 40 is reversely bent to define a second horizontal portion 48, as shown in FIGS. 4*a* and 4*b*. At the free end of the horizontal portion 48 is provided lateral connector means 42 including a male connector 44 that extends laterally outwardly from the terminal portion 48. The lateral contact means 42 also includes a female jack connector 46, as shown in FIG. 4*b*.

Figure 3:
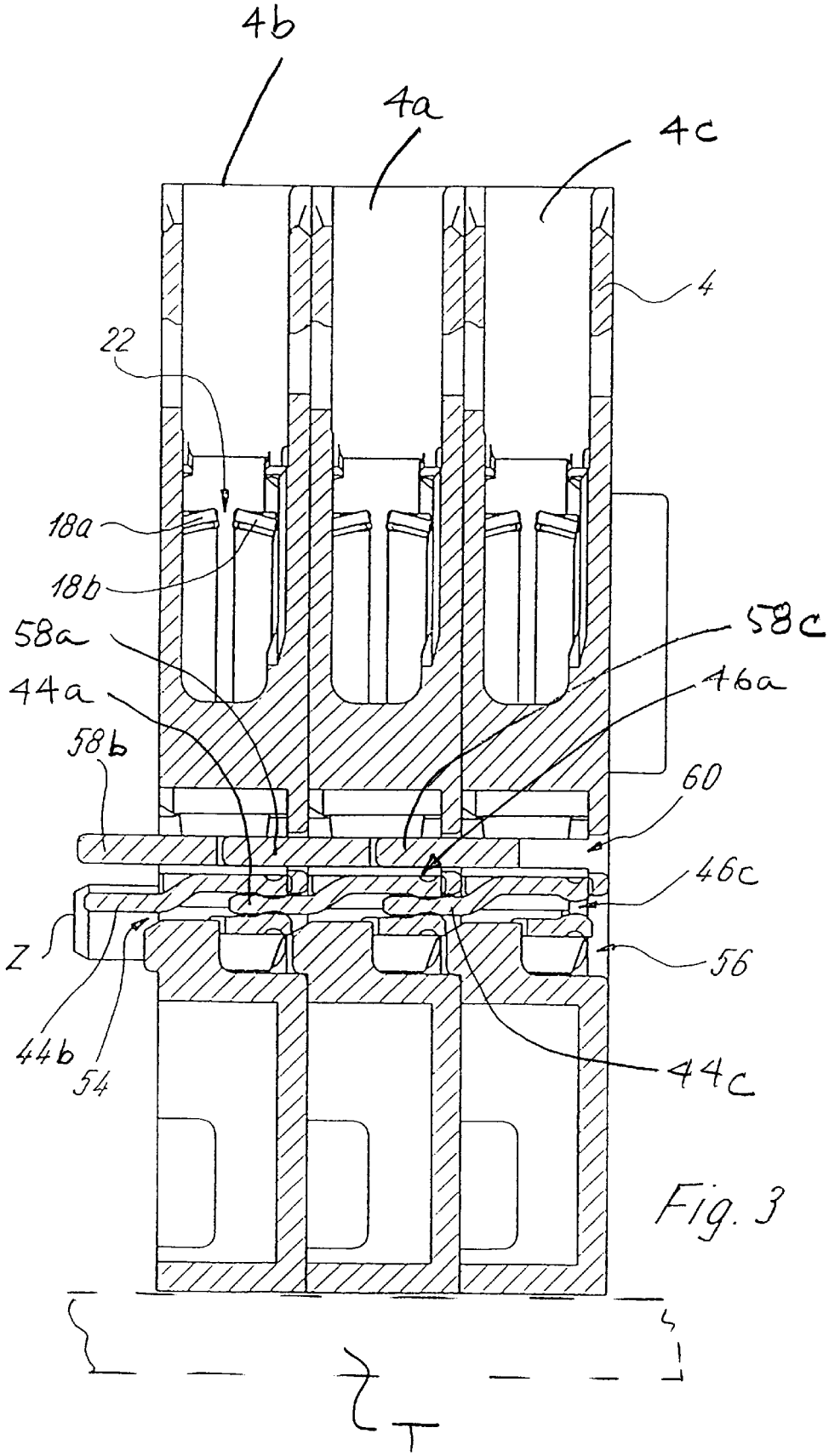
FIG. 3 is a transverse sectional view illustrating the lateral connections between a plurality of terminal blocks mounted on a common mounting rail.

Referring to FIG. 3, it will be seen that a plurality of terminal bodies 4*a*, 4*b*, and 4*c* may be mounted on a common supporting rail T. The lateral male contact 44*a* of the central terminal block body 4*a* extends within the corresponding jack contact 46*b* of the adjacent terminal block body 4*b*, while the jack contact 46*a* at the right hand side of the terminal block body 4*a* receives the male contact 44*c* of the terminal block 4*c* that is arranged on the opposite side of the first terminal block from the second terminal block body 4*b*. As shown in FIG. 3, the terminal blocks 4*a*, 4*b*, and 4*c* are provided with protective projecting portions 58*a*, 58*b*, and 58*c*, that extend within corresponding recesses 60 provided in the adjacent terminal block body. Thus, the projecting housing portions 58 comprise safety projections that extend over the protruding male connectors 44*a*, 44*b*, and 44*c*, respectively. Alignment pegs Z extend laterally outwardly from the terminal block bodies for introduction into corresponding guide recesses 56 contained in the terminal block bodies, thereby to align the terminal block assemblies as they are mounted on the support rail T.

Figure 4C:
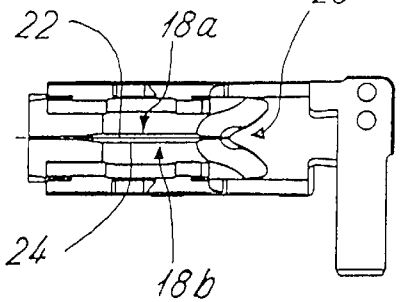
Figure 5A:
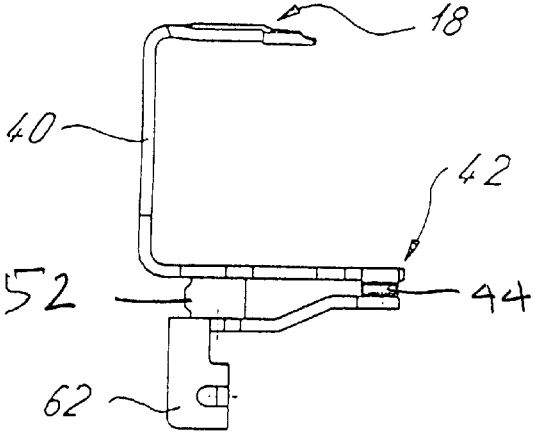
FIGS. 5*a*–5*d* are side elevation, side perspective, left hand end, left end, perspective, and top views, respectively of the electrical terminal of FIGS. 1–4.
Figure 5C:
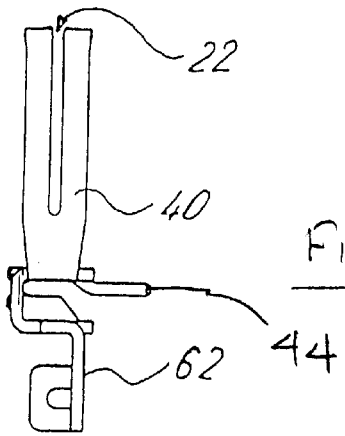
Figure 5B:
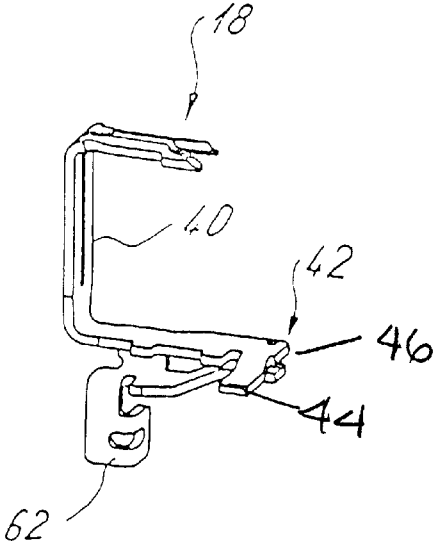
Figure 5D:
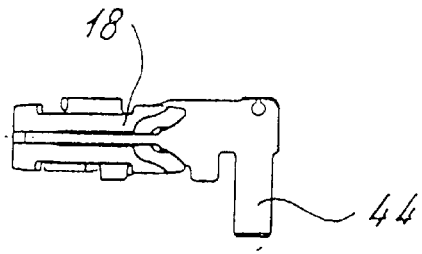
Figure 6:
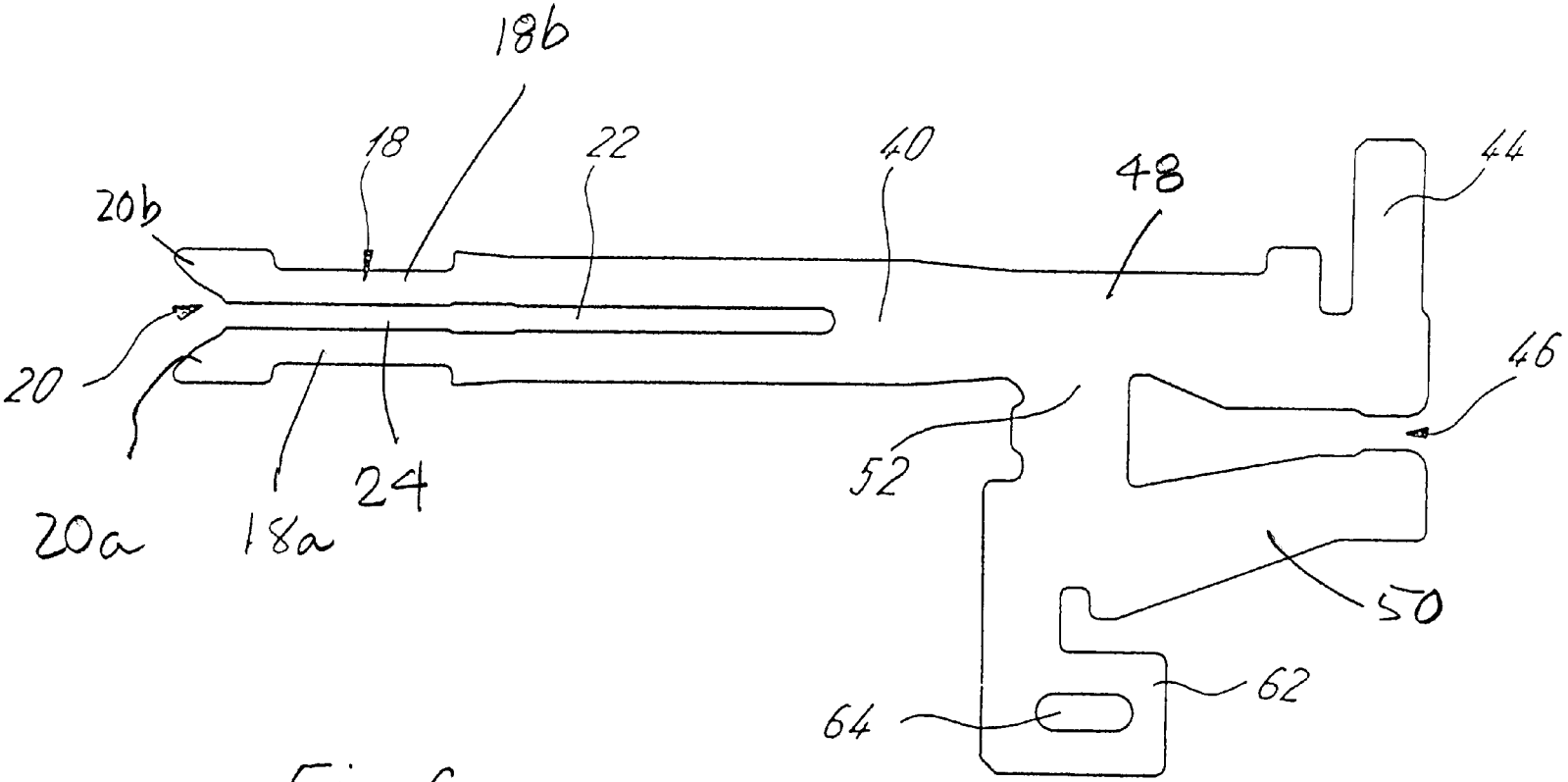
FIG. 6 is a plan view of the sheet metal blank from which the electrical terminal is formed.
Figure 7A:
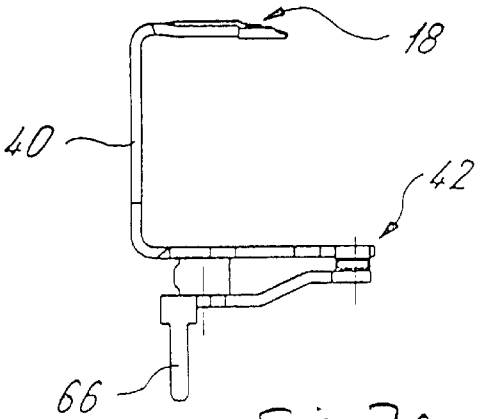
FIGS. 7*a*–7*d* are side elevation, perspective left hand end, and top views, respectively, of a first modification of the electrical terminal of FIGS. 5*a*–5*d;*
Figure 7C:
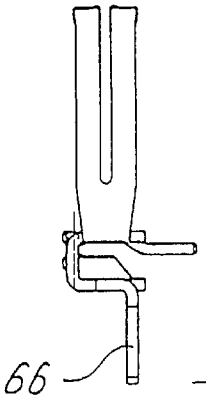
Figure 7B:
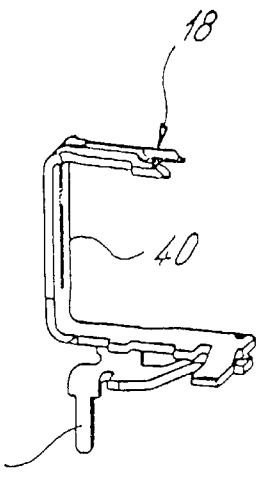
Figure 7D:
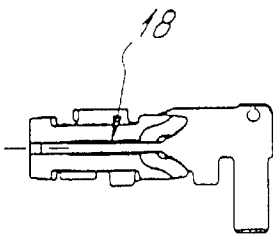
Figure 8A:
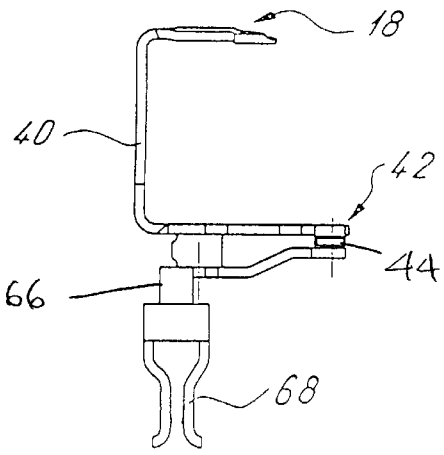
FIGS. 8*a*–8*d* are side elevation, perspective left hand end, and top views of a second modification of the electrical terminal of the present invention.
Figure 8C:
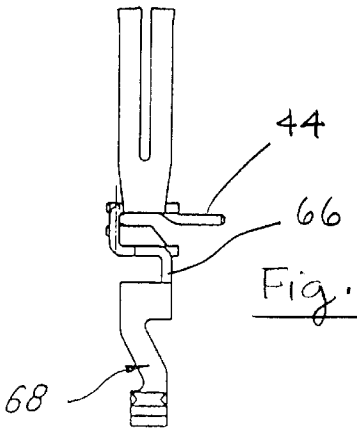
Figure 8B:
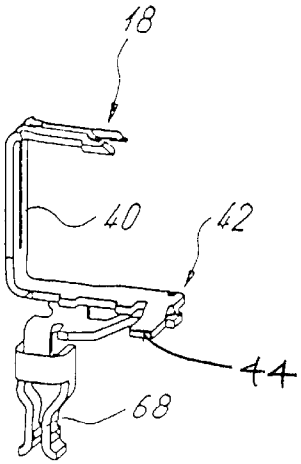
Figure 8D:
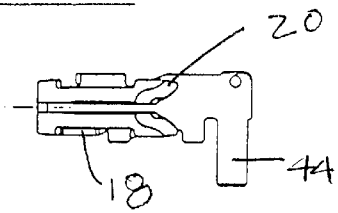

Referring more particularly now to FIGS. 4–6, the cutting terminal 12 may be formed by stamping from a sheet of conductive material. At one end, the cutting terminal contains a slot 22 that defines the body portions 18*a* and 18*b* of the bifurcated stationary contact 18, as well as the knife edge portions 20*a* and 20*b*. At its other end, the body portion 48 is provided with the laterally extending male connector 44, and the jack connector means 46 defined by the cooperation between the terminal portions 48 and 50 that are folded about the connecting portion 52, as shown in FIG. 4*a*. Thus, the jack connector 46 has a generally U-shaped longitudinal cross-sectional configuration with the planar horizontal leg portions 48 and 50 being joined by a bridging portion 52. The male connector 44 is offset from the leg 48 by a crimped connecting portion 44*d*, thereby to position the male connector in the horizontal plane that passes centrally of the jack connector 46. A further portion 62 is bent downwardly from the horizontal portion 50 and contains a soldering opening 64 by means of which an electrical component such as a diode may be soldered to the terminal. As seen in FIGS. 5*b* and 6, the slot 22 extends partially within the vertical portion 40 of the cutting terminal, and defines areas 24 for engaging the conductor C contained within the layer of insulation I. Thus, in operation, when the insulated conductor C is introduced within the opening 34 of an actuator member 30 in the disengaged position, upon displacement of the actuator member 30 toward the engaged position by the use of a an operating tool (such as the tip of a screw driver), the knife edges 20 pierce the insulation layer I on opposite sides of the conductor, thereby causing the contact areas 24 to engage the conductor C, as is known in the art. The conductor may then be connected by the terminal vertical portion 40 and male connector 44 to a corresponding terminal carried by the next terminal block body that is mounted on the support rail T, and the terminal 12 may be connected with a corresponding terminal on the other side of the terminal body by means of the jack connector 46 which receives the projecting lateral male connector of the adjacent terminal block assembly.

In the embodiment illustrated in FIGS. 7*a*–7*d*, instead of the downward extension 62 of the embodiment of FIG. 4, the terminal 40 includes a downwardly extending soldering pin 66 that is orthogonally arranged relative to the horizontal portion 50 of the terminal 40. As shown in FIGS. 8*a*–8*d*, a vertically downwardly extending jack connection 68 may be secured to the lower end of the soldering pin 66, if desired.

In the modification FIGS. 9*a*–9*d*, the terminal 40' may have a L-shaped configuration and the lateral connectors 42 are provided at the lower end of the vertical portion of the terminal 40. Thus, the jack connector 46' is arranged at the lower end of the vertical portion 40' of the terminal, and the male connector 44' extends orthogonally of the terminal, as best shown in FIGS. 9*b* and 9*c*.

Figure 10:
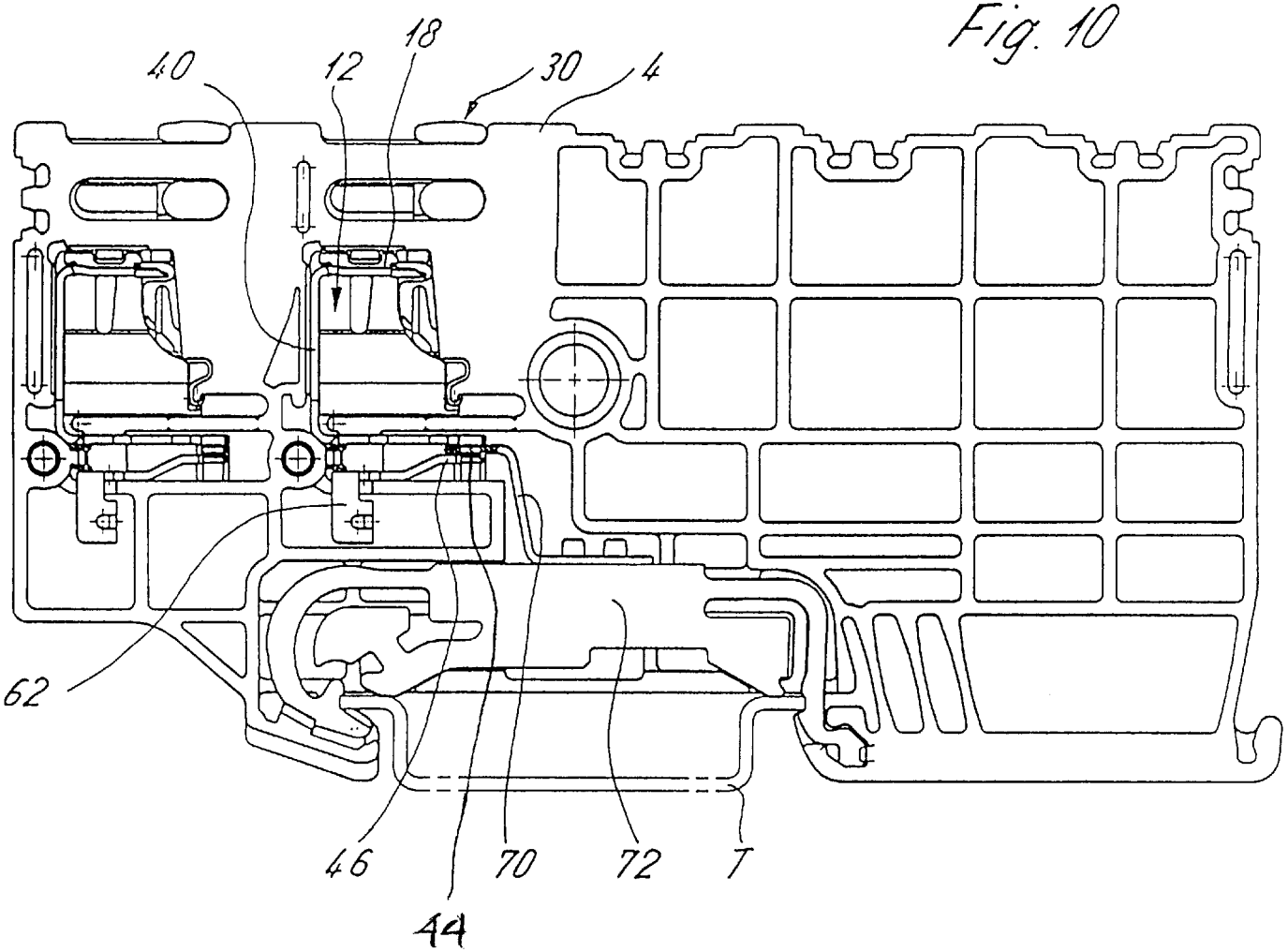
FIG. 10 is a side elevation view illustrating a terminal block assembly having a terminal that is electrically connected with the support rail.

Referring now to FIG. 10, the terminal block body 4 contains the terminal 12 that is connected with the grounded support rail T via the jack connector 46 and a connecting bus bar portion 70 that is connected with the conductive contact foot 72 that engages the support rail 7. The terminal 12 could be connected with a corresponding terminal of the adjacent terminal block assembly by means of the laterally projecting male contact member 44, thereby to ground said adjacent terminal block assembly.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A terminal block assembly adapted for connection with an insulated electrical conductor, comprising:

(a) a generally rectangular horizontally arranged terminal block body (4) formed of electrical insulating material and containing at least one open-topped chamber;

(b) a stationary resilient electrical terminal (12) mounted in said chamber, said terminal including:

(1) a horizontal bifurcated first contact means (18) terminating at a first end in bifurcated knife means (20), said first contact means extending longitudinally of said terminal block body and having an other end; and (2) a vertical support portion (40) having an upper end connected with said stationary contact other end, said vertical support portion having a lower end;

(c) a vertically arranged actuator member (30) mounted in said chamber for displacement between disengaged and engaged positions relative to said stationary contact, said actuator member having an upper end containing a vertical bore (34) for receiving one end of the insulated conductor when said actuator member is in said disengaged position, said actuator member being operable during displacement toward said engaged position to cause the layer of insulation in the conductor to be pierced by said knife means and thereby effect electrical engagement between said stationary contact and the electrical conductor; and (d) stationary second contact means (42) carried by the other end of said vertical terminal portion, said second contact means including:

(1) at least one horizontal female jack connector (46); and (2) a horizontal male connector (44) that extends laterally outwardly beyond said terminal block body.

2. A terminal block assembly as defined in claim 1, wherein said jack connector and said other connector are horizontally arranged and extend in opposite directions transversely of said terminal block body, thereby to permit connection of said terminal with a corresponding electrical component on an adjacent terminal block assembly.

3. A terminal block assembly as defined in claim 2, and further including:

(e) a horizontal support rail (T);

(f) a plurality of said terminal block assemblies being mounted in stacked parallel relation transversely of said support rail, the male connector of one terminal block assembly extending into the jack connector of the adjacent terminal block assembly on one side thereof, and the jack connector of said one terminal block assembly on the other side thereof.

4. A terminal block assembly as defined in claim 3, wherein said terminal block body contains first and second lateral recesses (54 and 56) receiving said male and jack connectors, respectively.

5. A terminal block assembly as defined in claim 4, wherein said terminal block body includes a protective ledge portion (58) that extends laterally outwardly from said terminal block body above said first recess and said male connector.

6. A terminal block assembly as defined in claim 2, wherein said female jack connector has a generally U-shaped longitudinal cross-sectional configuration including a pair of parallel leg portions (48, 50) joined by a bridging portion (52).

7. A terminal block assembly as defined in claim 6, wherein said male connector (44) extends parallel with and orthogonally from the end of one of said jack connector leg portions.

8. A terminal block assembly as defined in claim 7, wherein said male connector is offset from the plane of said one jack leg portion by a crimped connection **(44*a*)**, thereby to offset said male connector to a position in a plane extending generally centrally of said jack connector.

9. A terminal block assembly as defined in claim 2, wherein said stationary second contact means further includes an auxiliary connector (62, 66, 68) that is angularly arranged relative to said male connector.

10. A terminal block assembly as defined in claim 9, wherein said auxiliary connector includes a body portion **(62*a*), and an orthogonally arranged tab portion (62*b*) connected with said connector body portion by a fold line containing a soldering opening (64)**.

11. A terminal block assembly as defined in claim 9, wherein said auxiliary connector comprises a downwardly extending soldering pin (66).

12. A terminal block assembly as defined in claim 9, wherein said auxiliary connector comprises a second jack connector (68).

13. A terminal block assembly as defined in claim 1, wherein said terminal is an integral member stamped from a single metal sheet and bent to form.

14. A terminal block assembly as defined in claim 1, wherein said terminal has a generally U-shaped cross-sectional configuration with said first and second contact means extending horizontally from the upper and lower ends of said vertical support portion, respectively.

15. A terminal block assembly as defined in claim 1, wherein said terminal has a generally inverted L-shaped configuration with said first contact means extending horizontally from the upper end of said vertical support means, said second contact means extending vertically downwardly from the lower end of said vertical support portion.

16. A terminal block assembly as defined in claim 1, and further including:

(e) a grounded support rail (T), said terminal block body being mounted on said support rail; and (f) means including a bus bar conductor (70) and a conductive foot (72) electrically connecting said jack connector with said support rail.

17. A terminal block assembly as defined in claim 1, and further including guide means (31, 32) for guiding said actuator member for displacement relative to said terminal block body.

18. A terminal block assembly as defined in claim 1, wherein said male connector and said female jack connector are of integral construction.

* * * * *